US006799960B2

(12) United States Patent
Moore

(10) Patent No.: US 6,799,960 B2
(45) Date of Patent: Oct. 5, 2004

(54) SPINNERETTE ASSEMBLY FOR FORMING HOLLOW FIBERS

(75) Inventor: Samuel Earl Moore, Middletown, DE (US)

(73) Assignee: L'Air Liquide - Societe Anonyme a Directoire et Consiel de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 20 days.

(21) Appl. No.: 09/733,304

(22) Filed: Dec. 8, 2000

(65) Prior Publication Data

US 2002/0070477 A1 Jun. 13, 2002

(51) Int. Cl.[7] ..... D01D 5/34

(52) U.S. Cl. ..... 425/131.5; 425/133.1; 425/382.2; 425/463; 425/DIG. 217

(58) Field of Search ..... 425/382.2, DIG. 217, 425/453, 131.5, 133.1, 192 S; 264/172.11, 172.15, 541, 171.27

(56) References Cited

U.S. PATENT DOCUMENTS 2,818,034 A * 12/1957 Kinkead ..... 425/463
3,453,689 A * 7/1969 Hume ..... 425/131.5
3,526,571 A * 9/1970 Ogata ..... 428/373
4,315,877 A * 2/1982 Coplan et al. ..... 264/45.9
5,320,512 A * 6/1994 Moore, Sr. ..... 425/131.5

* cited by examiner

*Primary Examiner*—Robert Davis
*Assistant Examiner*—Joseph S Del Sole
(74) *Attorney, Agent, or Firm*—Linda K. Russell; Elwood L. Haynes

(57) ABSTRACT

The invention provides a spinnerette assembly for forming hollow fibers. The spinnerette assembly contains an extrusion orifice and a fiber-forming material passage in communication with the extrusion orifice. A hollow needle extends through the extrusion orifice in a concentric manner to define an annular passage surrounding the needle. The fiber-forming material passage includes a fiber-forming material inlet port extending from a surface of the spinnerette assembly to an interior of the assembly and a transverse passage extending from the fiber-forming material port to the annular passage surrounding the needle. A bore forming fluid passage communicates with the interior of the needle.

3 Claims, 4 Drawing Sheets

SPINNERETTE ASSEMBLY FOR FORMING HOLLOW FIBERS

FIELD OFTHE INVENTION

This invention relates to spinnerette assemblies for forming hollow fibers. It particularly relates to an improved spinnerette for more efficient and precise production of hollow fibers.

BACKGROUND OFTHE INVENTION

It is well known to use various hollow fibers for various applications. For example, hollow fibers are used in carpets, as fill materials for pillows, as insulation materials for blankets and garments, and as membranes for gas separation, blood dialysis, purification of water, and other filtering applications. For membrane applications, the hollow fibers can be bundled together and disposed in a tubular housing to provide a separation device known as a permeator. Ordinarily, the hollow fibers are relatively small, having a diameter on the order of 30 to 1000 micrometers. Accordingly, the apparatus and method for manufacturing hollow fibers must be very precise to be able to control the diameter of the fiber, and the concentricity of the core around the bore.

Numerous spinning assemblies have been devised for the production of hollow fibers. Particularly, devices have been proposed for ensuring uniform supply of the fiber-forming fluid or fluids to the orifices of a spinnerette with the object of producing hollow fibers identical in diameter, composition, and concentricity. These spinnerettes use a means for supplying the bore fluid positioned in the spinning orifice for forming the bore or "hollow" of the hollow fiber. Usually, a tube or needle is used for this purpose and a gaseous or liquid fluid is injected from the tube, thus forming the bore of the fiber as it is being extruded from the spinnerette orifice. For melt spinning, the nascent fiber can be solidified by cooling in a gaseous or liquid cooling fluid. For solution spinning, the nascent fiber can be solidified by evaporation of the solvent or by contacting the fiber with a solvent-extracting liquid that results in coagulation of the polymer solution(s) to form the fiber wall.

In order to maintain the concentricity of fiber diameter and the bore diameter, other spinnerettes have been provided with members for centering the tube and the bore of the spinnerette plate. For example, U.S. Pat. No. 4,493,629 describes a modular spinnerette assembly fitted with multiple screws threaded through the spinnerette plate to center the tube and orifice of the spinnerette. However, these adjusting screws are unreliable and are prone to error when the spinnerette is disassembled, cleaned and then reassembled.

Typically, spinnerettes of this type are made largely by hand, one at a time. As a result, parts made for one spinnerette will not always fit another spinnerette. When parts are not interchangeable, any damage to one part of the spinnerette assembly may render the entire assembly useless. In assembling or cleaning conventional hollow-fiber spinnerettes, it is very easy to slightly bend the fluid-injection tube or needle, such that it is off center of the spinning orifice. When this happens, the spinnerette cannot be used until repaired.

Yet another problem with existing spinnerette designs is the ability to deliver the polymer fluid uniformly around the tube or needle within the spinnerette. U.S. Pat. No. 5,320,512 discloses a spinneret that has a plurality of discrete material passages formed around the needle to deliver the polymer fluid around the needle. This design enables the uniform delivery of the polymer fluid around the tube or needle within the spinnerette. However, in order to attain concentricity and uniformity in the manufacturing process, the polymer fluid from these individual passages must converge and meld together to form a singular annular flow around the tube or needle as the polymer fluid traverses through the main polymer fluid passage. If complete convergence and melding are not attained, seams may develop down the length of the spun fiber at the interfaces where the individual flows did not fully converge and meld together completely.

Thus, there still remains a need to overcome this problem of interface convergence and melding of the fluid polymer in order to be able to produce a concentric spun hollow fiber with minimal seaming potential.

SUMMARY OF THE INVENTION

The present invention provides an improved spinnerette for the production of hollow fibers.

It is an object of the invention to overcome the limitations of conventional spinnerettes.

It is another object of the invention to reduce imperfections in hollow fibers.

It is another object of the invention to extend hollow-fiber production run times.

It is another object of the invention to reduce the time for spinnerette maintenance.

It is another object of the invention to simplify spinnerette fabrication.

To achieve these objects, a first aspect of the invention is a spinnerette assembly for forming a composite hollow fiber comprising:

- at least one extrusion orifice formed in said spinnerette assembly;
- a hollow needle extending through each said extrusion orifice in a concentric manner to define an annular passage around said needle in said extrusion orifice;
- a bore forming fluid passage communicating with an interior of each said needle; and
- at least one fiber-forming material passage formed in said spinnerette assembly, wherein each said fiber-forming material passage comprises a fiber-forming material inlet port extending from a surface of said assembly to an interior of said assembly and at least one transverse passage extending from said fiber-forming material port to each said annular passage, wherein a portion of said transverse passage entirely surrounds each said needle in a continuous manner.

A second aspect of the invention is a method of forming a composite hollow fiber comprising the steps of:

- delivering a fiber-forming material to each annular passage in the spinnerette assembly, said fiber-forming material entering the spinnerette assembly through one or more fiber-forming material inlet ports and passing through the interior of said assembly to a transverse passage, a portion of said transverse passage entirely surrounding each needle in a continuous manner, and through an annular passage in communication with an extrusion orifice, and
- injecting a bore forming fluid into each needle to thereby provide a fiber comprising a bore forming fluid, and a fiber-forming material as it exits the spinnerette assembly through the extrusion orifice, optionally passing the nascent extruded hollow fiber through an air gap, and solidifying the hollow fiber by cooling, solvent evaporation, or solvent extraction.

BRIEF DESCRIPTION OF THE DRAWINGS

The invention is described through a preferred embodiment and the attached drawings in which.

DETAILED DESCRIPTION OF THE PREFERRED EMBODIMENT

Figure 1:
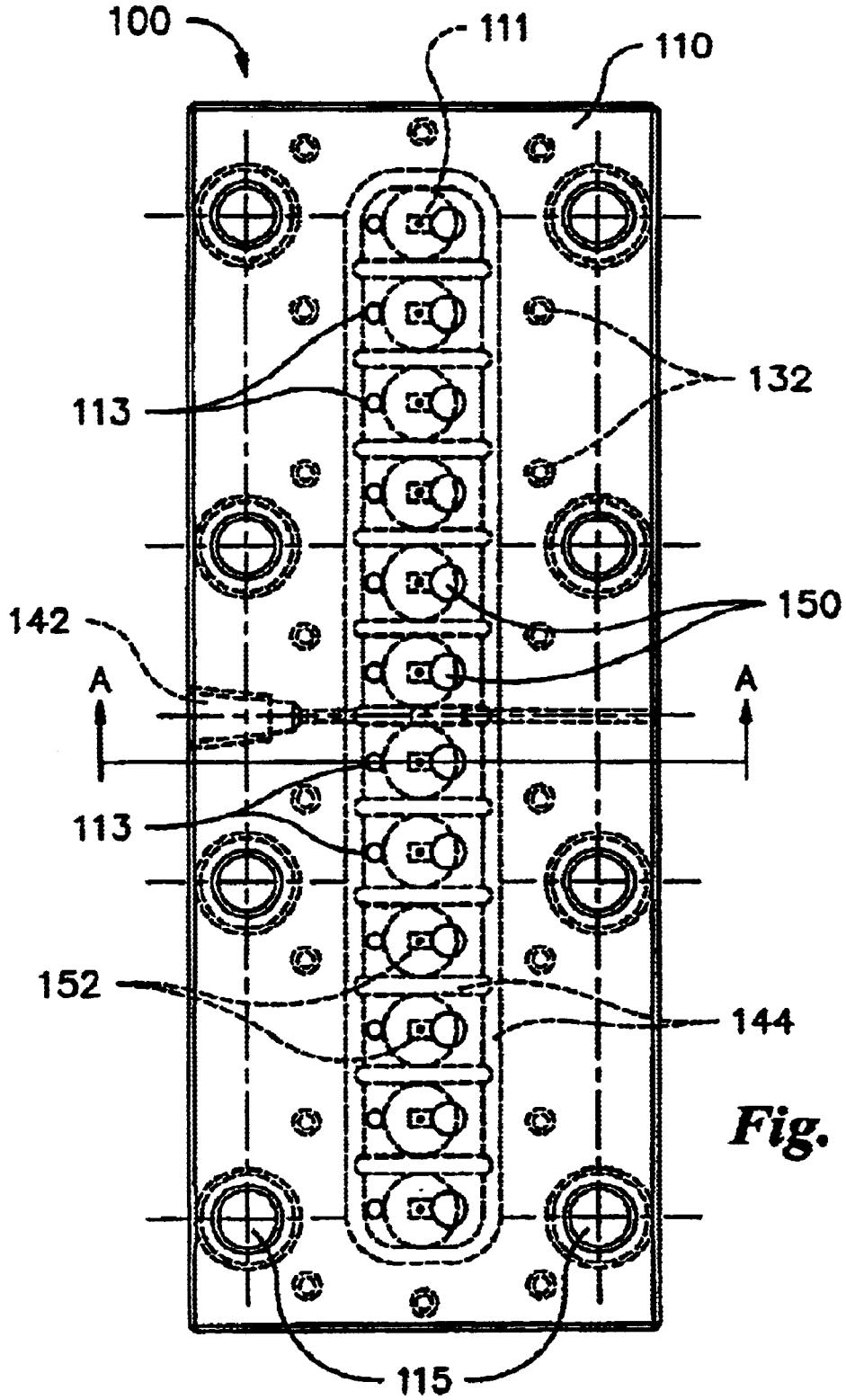
FIG. 1 is a top view of a spinnerette according to a first preferred embodiment of the invention.
Figure 2:
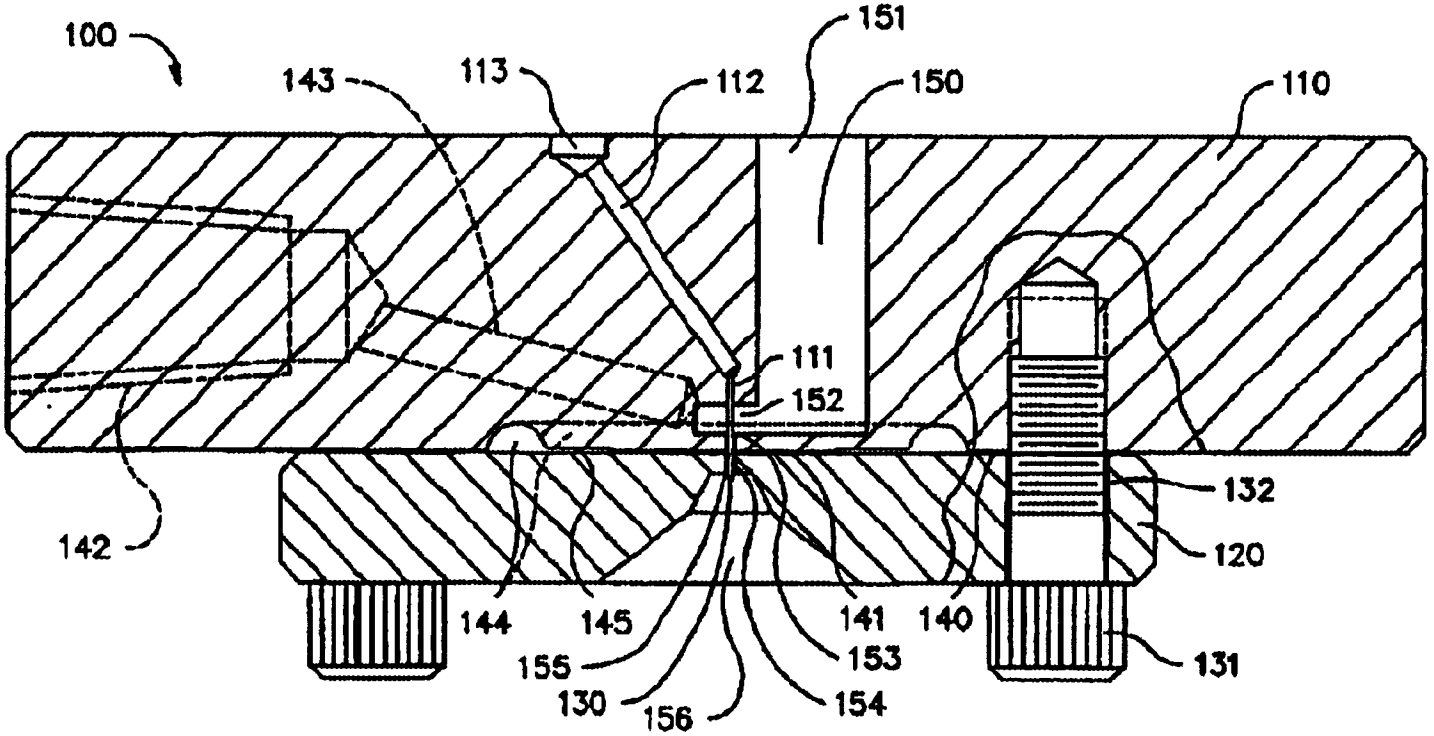
FIG. 2 is a sectional view of the first preferred embodiment taken along line A—A in FIG. 1 showing one extrusion arrangement.

In the first preferred embodiment of the invention for the extrusion of multiple hollow fibers, as illustrated in FIGS. 1 and 2, a spinnerette assembly 100 comprises a spinnerette body 110, bottom plate 120, and needles 130. The specific arrangement shown in FIG. 1 is for simultaneous extrusion of twelve hollow fibers, but the spinneret assembly 100 can be modified to produce a single filament or any number of multiple filaments as may be required. A proximal end of each needle 130 is secured in a respective needle mounting hole 111 formed in spinnerette body 110 by drilling or another machining process. The outer diameter of the proximal end of needle 130 and the diameter of mounting hole 111 preferably are sized such that the proximal end of needle 130 can be pressure fitted into needle mounting hole 111 to secure needle 130 to spinnerette body 110. Needle 130 can be secured to spinnerette body 110 in any appropriate manner that permits access of the bore at the proximal end of needle 130 to the bore forming fluid passages 112 in the spinnerette body 110. Bottom plate 120 is secured to spinnerette body 110 by fasteners 131, such as bolts or the like threaded through holes 132. Flared recesses 156 are formed in bottom plate 120 to permit the multiplicity of extruded fibers to exit spinnerette assembly 100 without interference. In the preferred embodiment, the multiple extrusion arrangements are situated in a linear or circular fashion.

Bore forming fluid passage 112 is formed in spinnerette body 110 and extends through spinnerette body 110 to a respective needle mounting hole 111 to be in communication with the passage formed through needle 130. Each bore forming fluid passage 112 includes a bore forming fluid inlet port 113 at the surface of spinnerette body 110. This structure permits a bore forming fluid to be introduced into an extruded fiber to maintain the hollow structure of the extruded fiber in the manner described below.

Fiber-forming material passages 150 are formed in spinnerette body 110 through which a fiber-forming material, such as a polymer material, is delivered to the extrusion orifices 155. Each fiber-forming material passage 150 includes an inlet port 151 that is a hole extending in a direction that is substantially parallel to needle 130. Each fiber-forming material passage 150 also includes a transverse passage 152 that extends from fiber-forming inlet port 151 to a top portion of annular passage 153 that defines the upper portion of extrusion orifice 155. Transverse passage 152 is defined by a backcut portion formed in spinnerette body 110 by a tool inserted through fiber-forming material port 151. Transverse passage 152 extends entirely around needle 130 to permit fiber-forming material to be evenly distributed around needle 130 and evenly introduced into annular passages 153 and 154.

In operation, spinnerette assembly 100 is mounted to a spinning machine through mounting holes 115 using an appropriate fastening mechanism such as bolts or the like. A bore forming fluid supply and a fiber-forming material supply of the machine are coupled respectively to the bore forming fluid inlet port 113 and the fiber-forming material inlet port 151. Note that there is one bore forming material inlet port 113 and one fiber-forming material inlet port 151 for each extrusion orifice 155. These ports can be arranged in any way and can be of any number as is appropriate to deliver the materials to the proper passages. For the spinning of hollow fibers, a fiber-forming material and a bore forming fluid are simultaneously delivered into spinneret 100 at know pressures and flow rates to extrude (i.e., spin) hollow fibers. Typically, the fiber-forming material is injected at about 300–500 psig and the bore forming fluid is injected at about 4–5 psig.

Fiber-forming material travels through fiber-forming material inlet port 151, through the fiber-forming material passage 150, into transverse passage 152, and into upper annular passage 153. Simultaneous with the delivery of the fiber-forming material, a bore forming fluid is injected into the bore forming fluid inlet port 113, through bore forming fluid passage 112, and into needle 130. The bore fluid emerges from the distal end of needle 130 at a position within or just downstream of extrusion orifice 155. Since the fiber-forming material is being extruded through the lower annular passage 154 and out of the extrusion orifice 155 concentrically around needle 130 and the emerging bore forming fluid therefrom, the resultant extrudate is a fiber comprised of a bore forming fluid at the center, concentrically surrounded by a fiber-forming material.

As best illustrated in FIGS. 1 and 2, transverse passage 152 is a backcut portion having a terminal portion that entirely surrounds needle 130 in a continuous manner and is in communication with upper annular passage 153. This construction eliminates the problem of uniform distribution of fiber-forming material around needle 130. It also eliminates the problem of longitudinal seaming down the fiber wall due to incomplete melding of a plurality of fiber-forming material streams within the annular passage as disclosed in U.S. Pat. No. 5,320,512. Also, since the fiber-forming material passage 150 and transverse passage 152 are readily accessible when the spinnerette assembly is removed from the spinning machine, cleaning of the spinnerette is relatively easy. This facilitates cleaning and reduces turnaround time for the spinnerette. Also, fiber-forming material passage 150 can be easily machined in spinnerette body 110 by drilling, and transverse passage 152 can be easily and precisely formed by EDM techniques using an angular electrode. Further, since needle 130 is securely fixed to the spinnerette body into mounting hole 111, alignment of the needle concentrically within upper and lower annular passages 153 and 154 is assured and thus laborious and intricate alignment processes are obviated, thereby further reducing turnaround time.

Figure 3:
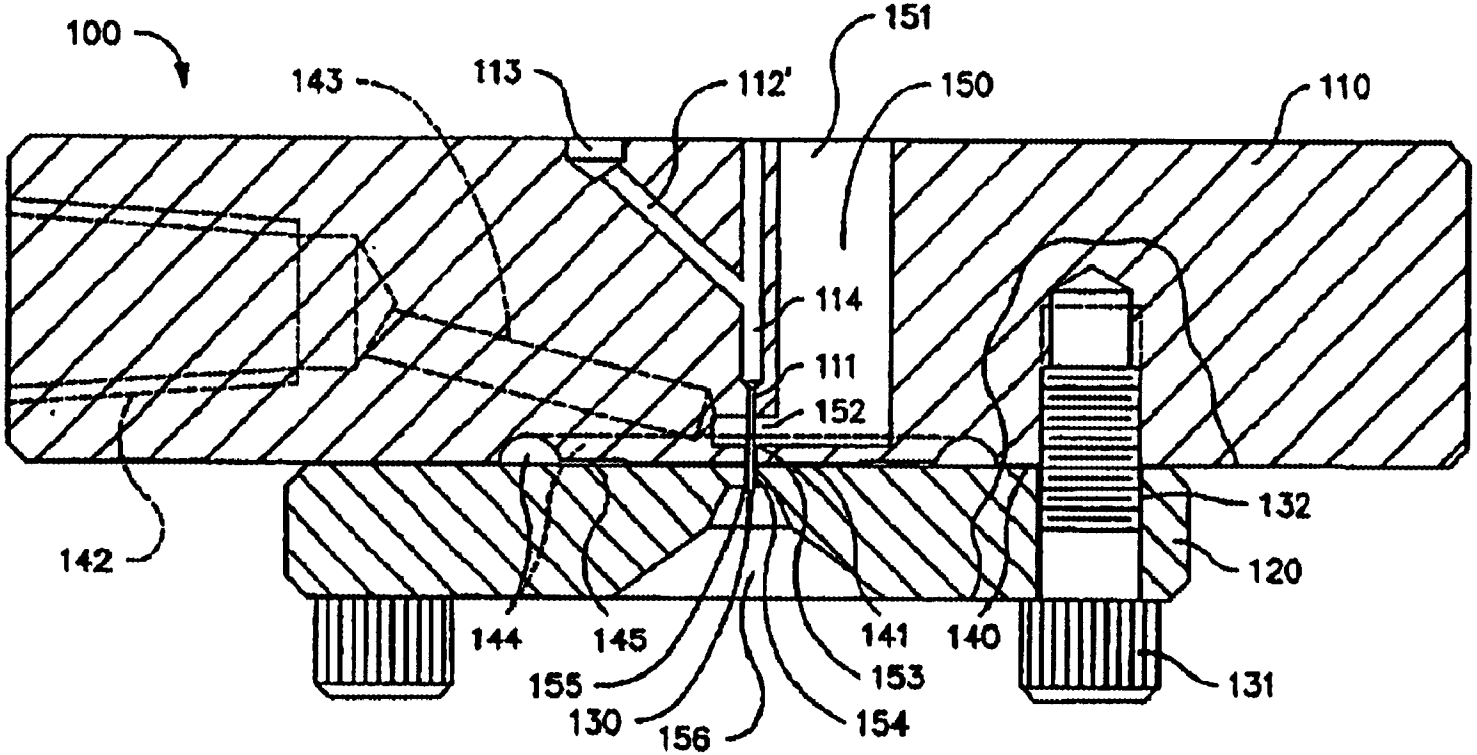
FIG. 3 is an alternative construction of spinnerette body of the first preferred embodiment.

Spinnerette assembly 100 of the preferred embodiment has fewer parts and is more easily manufactured as compared to conventional spinnerettes. FIG. 3 illustrates an alternative construction of the spinnerette body of the first preferred embodiment that further simplifies the spinnerette manufacturing process. In the first preferred embodiment depicted in FIG. 2, bore forming fluid passage 112 must be machined, e.g. drilled, at an angle and with a high degree of precision to accurately meet and communicate with needle mounting hole 111 without damaging the integrity of needle mounting hole 111, which has a relatively small diameter. The spinnerette body of FIG. 3 has an alternative design that obviates this intricate machining step and thus reduces the cost of manufacturing a spinnerette. In particular, a secondary bore forming fluid passage 114 is machined substantially coaxial to fiber-forming material passage 150 and extends from the surface of spinnerette body 110 to needle mounting hole 111, and is concentric with needle mounting hole 111. Since secondary bore forming fluid passage 114 is coaxial with needle mounting hole 111, the machining process is greatly simplified. Bore forming fluid passage 112' is machined in spinnerette body 110 so as to originate at bore forming fluid inlet port 113 and intersect with secondary bore forming fluid passage 114 at a point substantially removed from needle mounting hole 111. Angled bore forming fluid passage 112' is readily machined to communicate with secondary bore forming fluid passage 114 (that can be machined prior to machining angled passage 112') because the diameters of angled passage 112' and passage 114 are relatively large as compared to the diameter of needle mounting hole 111. The opening of secondary bore forming fluid passage 114 at the face of spinnerette body 110 can be plugged or otherwise sealed prior to or during mounting of the spinnerette assembly 100 onto the spinning machine to avoid leakage of the bore forming fluid. Other aspects of the alternative design of FIG. 3 are similar to the design of FIG. 2 described above.

Figure 4:
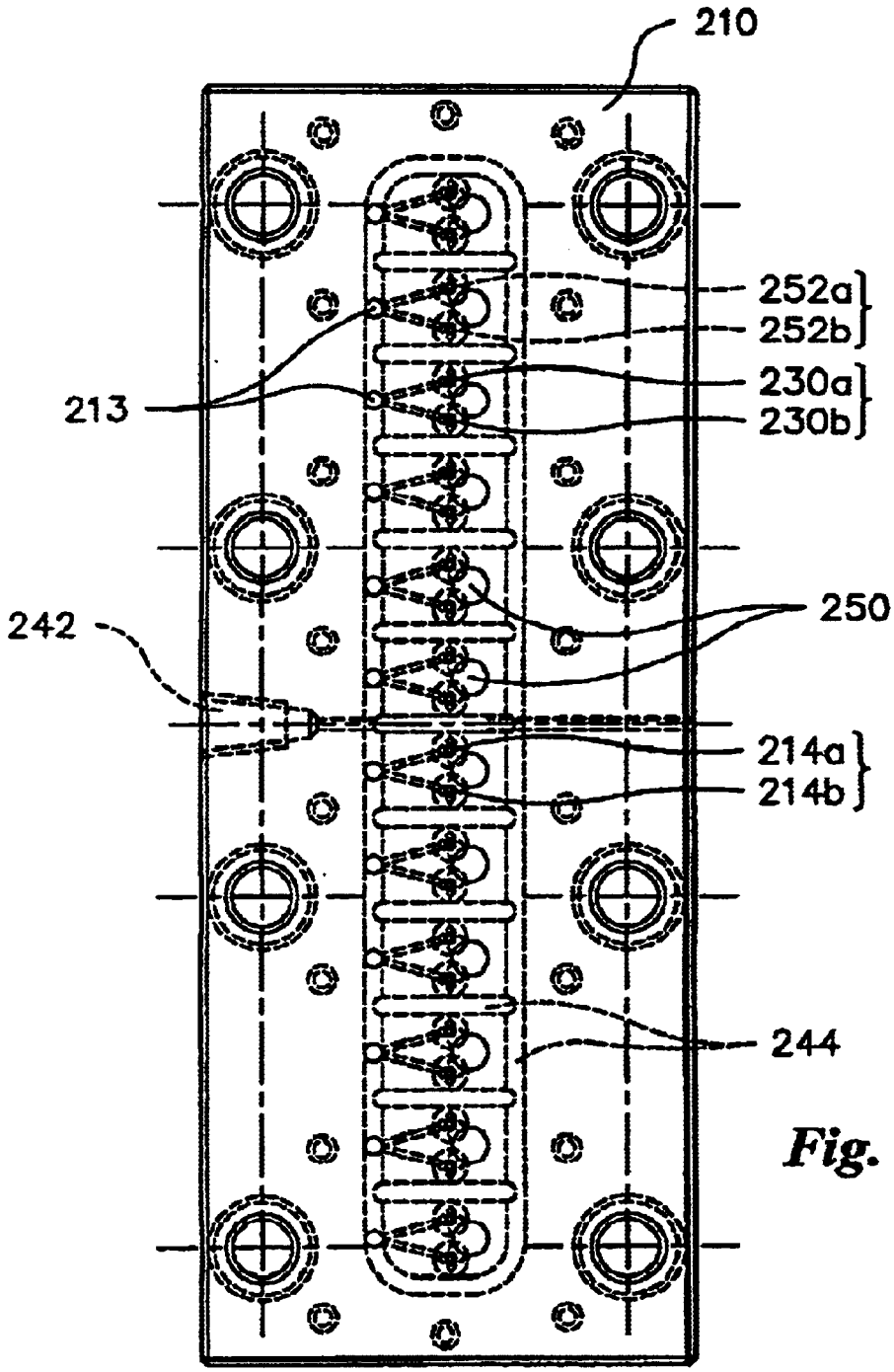
FIG. 4 is a top view of a second preferred embodiment of the invention for spinning multiple filaments from a single fiber-forming material passage.

A second preferred embodiment in accordance with the invention is illustrated in FIG. 4, which depicts a method for increasing the number of fibers per spinnerette by a factor of two. For illustrative purposes and clarity, the numeration used in FIG. 4 is 100 greater than for corresponding components in FIGS. 1, 2, and 3. FIG. 4 is a top view of spinnerette body 210. The distinguishing feature between this embodiment and the one depicted in FIGS. 1, 2, and 3 is that for each fiber-forming material passage 250 are formed two transverse passages 252*a* and 252*b*, each in the form of a backcut portion. Each traverse passage 252*a* and 252*b* are provided with an annular passage 253*a* and 253*b* respectively (corresponding to annular passage 153 in FIGS. 2 and 3), and needles 230*a* and 230*b* (corresponding to needles 130 in FIGS. 2 and 3). Similarly, other features in spinnerette body 110 and bottom plate 120 depicted in FIGS. 1, 2, and 3 are provided as corresponding features in spinnerette body 210 and bottom plate 220. Thus, with reference to FIGS. 3 and 4 the transverse passages 252*a* and 252*b* extend from fiber-forming material passage 250 to the edge of the annular passages 253*a* and 253*b* around each needle 230*a* and 230*b* of the corresponding extrusion orifice. Plural needles 230*a* and 230*b* are disposed in spinnerette body 210 and are in communication with bore forming fluid passage 214*a* and 214*b*. Each needle extends through a corresponding extrusion orifice 255*a* and 255*b* defined by the cylindrical upper and lower annular passages 253*a* and 253*b*, and 254*a* and 254*b* respectively. The bore forming fluid is supplied to spinnerette body 210 through bore forming fluid inlet port 213. The bore forming fluid is distributed from each bore forming fluid inlet port 213 through channels 212'*a* and 212'*b* to each bore forming fluid passages 214*a* and 214*b*. Accordingly, the spinnerette assembly 200 can be attached to the same spinning machine to produce twice as many fibers. One skilled in the art can envision additional embodiments to spin fibers in multiples greater than two (e.g., 3, 4, 5) based on the above embodiments.

The various ports, channels, and passages in the spinnerette assemblies described above can be formed in any manner and can be of any number to produce hollow fibers. For example, the fiber-forming material passage can be of any shape or configuration and can comprise plural channels or a single channel. The spinnerette assemblies can be machined using any known techniques such as drilling, electronic discharge machining (EDM), or any other suitable process or processes. There can be any number of extrusion orifices. The invention can be used to make hollow fibers of any type and of any material amenable to extrusion. The various angles and dimensions can be varied to suit the particular application. The spinnerette assemblies can be manufactured of any suitable material such as steel, monel, titanium, aluminum, or alloys thereof. The fiber-forming material can be of any type amenable to extrusion such as polymer melts or solutions, ceramic pastes, and the like. The bore forming fluid can be an inert gas or liquid for example.

The invention has been described through preferred embodiments. However, various modifications can be made without departing from the scope of the invention as defined in the appended claims.

What is claimed:

1. A spinnerette assembly for forming one or more hollow fibers comprising:

a unitary spinnerette body;

at least one extrusion orifice formed in said unitary spinnerette body;

a hollow needle being affixed in a needle mounting hole formed in said unitary spinnerette body and wherein said needle mounting hole receives a portion of said hollow needle;

a hollow needle extending through each said at least one extrusion orifice in a concentric manner to define at least one annular passage around said needle in said at least one extrusion orifice;

a bore forming fluid passage formed in said unitary spinnerette body, said bore forming fluid passage communicating with the interior of each said hollow needle, wherein each said needle mounting hole is in communication with a bore forming fluid inlet port at a surface of said unitary spinnerette body via said bore forming fluid passage, wherein said bore forming fluid passage further comprises a first bore forming fluid conduit coaxial with said needle and in communication with said needle and a second bore forming fluid conduit that extends at an angle with respect to said first bore forming fluid conduit from said bore forming fluid conduit to a surface of said unitary spinnerette body;

at least one fiber-forming material passage formed in said unitary spinnerette body, wherein each said at least one fiber-forming material passage comprises a fiber-forming material inlet port extending from a surface of said body to an interior of said body, wherein said fiber-forming material port extends substantially parallel to said extrusion orifice and at least one transverse passage extending form said fiber-forming material port to each said annular passage, wherein said traverse passage extends substantially perpendicular to said fiber-forming material port: and a bottom plate.

2. A spinnerette assembly as recited in claim 1, wherein said transverse passage is a backcut portion of said fiber-forming material passage that entirely surrounds said needle in a continuous manner and is in communication with said extrusion orifice.

3. A spinnerette assembly as recited in claim 1, wherein said extrusion orifice extends through portions of said unitary spinnerette body and said bottom plate.

* * * * *